US009501019B2

(12) United States Patent
Haruta

(10) Patent No.: US 9,501,019 B2
(45) Date of Patent: Nov. 22, 2016

(54) IMAGE PROCESSING APPARATUS AND CONTROL METHOD THEREOF

(71) Applicant: CANON KABUSHIKI KAISHA, Tokyo (JP)

(72) Inventor: Kenichirou Haruta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/601,771

(22) Filed: Jan. 21, 2015

(65) Prior Publication Data

US 2015/0220034 A1 Aug. 6, 2015

(30) Foreign Application Priority Data

Feb. 3, 2014 (JP) ..... 2014-018830

(51) Int. Cl.
*G03G 15/00* (2006.01)

(52) U.S. Cl.
CPC ..... *G03G 15/556* (2013.01)

(58) Field of Classification Search
CPC ..... G03G 15/0831
See application file for complete search history.

(56) References Cited

U.S. PATENT DOCUMENTS

| | | | |
|---|---|---|---|
| 8,335,441 | B2 | 12/2012 | Kubo et al. |
| 8,611,768 | B2 | 12/2013 | Kubo et al. |
| 2014/0064749 | A1 | 3/2014 | Kubo et al. |

FOREIGN PATENT DOCUMENTS

| | | | |
|---|---|---|---|
| JP | 2003122205 A | * | 4/2003 |
| JP | 2010-102317 A | | 5/2010 |

OTHER PUBLICATIONS

Machine Translation of JP 2003-122205 A obtained on Jun. 22, 2015.*

* cited by examiner

*Primary Examiner* — Gregory H Curran
(74) *Attorney, Agent, or Firm* — Fitzpatrick, Cella, Harper & Scinto

(57) ABSTRACT

To provide a technique for enabling to calculate a color material consumption amount with higher accuracy, an image processing apparatus comprises: an edge counting unit configured to count a number of edges forming boundaries between recording pixels and non-recording pixels of an image having undergone halftone processing; a pixel counting unit configured to count the number of recording pixels of the image; an image feature determination unit configured to determine an image feature of the image based on the number of edges, the number of recording pixels, and a resolution of the halftone processing; and a toner consumption amount calculation unit configured to calculate a toner consumption amount in the image using a toner consumption amount table corresponding to the image feature determined by the image feature determination unit.

11 Claims, 18 Drawing Sheets

1500d

| | | | | | | | | | | | | | |
|---|---|---|---|---|---|---|---|---|---|---|---|---|---|
| 0 | 0 | 0 | 0 | 0 | 15 | 33 | 33 | 33 | 33 | 48 | 64 | 64 | 64 |
| 0 | 0 | 15 | 33 | 33 | 33 | 64 | 112 | 128 | 128 | 128 | 159 | 196 | 196 |
| 64 | 64 | 97 | 128 | 128 | 128 | 143 | 196 | 222 | 222 | 222 | 240 | 255 | 255 |
| 196 | 196 | 196 | 207 | 222 | 222 | 222 | 222 | 255 | 255 | 255 | 255 | 255 | 255 |
| 255 | 255 | 255 | 255 | 255 | 255 | 255 | 255 | 255 | 255 | 255 | 255 | 255 | 255 |

| | | |
|---|---|---|
| 1/16 | 2/16 | 1/16 |
| 2/16 | 4/16 | 2/16 |
| 1/16 | 2/16 | 1/16 |

| | | |
|---|---|---|
| 0 | −1 | 0 |
| −1 | 5 | −1 |
| 0 | −1 | 0 |

IMAGE PROCESSING APPARATUS AND CONTROL METHOD THEREOF

BACKGROUND OF THE INVENTION

Field of the Invention

The present invention relates to calculation of the consumption amount of a color material in a printing apparatus.

Description of the Related Art

In an electrophotographic printing apparatus, a potential latent image optically drawn on a photosensitive member is developed with toner, and the toner image is transferred to a conveyed paper sheet and fixed on the sheet with heat and pressure, thereby creating a printout product. When the toner runs out during creation of the printout product, the productivity of the job is reduced. To avoid this, in many printing apparatuses, a mechanism for detecting the residual amount of the toner and informing a user of this is prepared.

For example, there is available a method of accumulating the number of printing pixels of an image, multiplying the accumulation value with a toner weight per pixel, and predicting a toner amount to be consumed. Since the toner amount to be consumed varies depending on a temperature, humidity, and state of the apparatus, the toner weight per pixel is corrected by outputting and measuring a patch in Japanese Patent Laid-Open No. 2010-102317.

However, the toner consumption amount for a print page having a single large tone region is different from that for a print page having small discrete tone regions. For example, to print small tone regions discretely, it is hard to attach toner to a small region to result in a small toner consumption amount. For this reason, in the related art described above, the toner consumption amount depending on the difference in the areas of the tone regions cannot be accurately predicted.

SUMMARY OF THE INVENTION

According to one aspect of the present invention, an image processing apparatus comprises: an edge counting unit configured to count a number of edges forming boundaries between recording pixels and non-recording pixels of an image having undergone halftone processing; a pixel counting unit configured to count the number of recording pixels of the image; an image feature determination unit configured to determine an image feature of the image based on the number of edges, the number of recording pixels, and a resolution of the halftone processing; and a toner consumption amount calculation unit configured to calculate a toner consumption amount in the image using a toner consumption amount table corresponding to the image feature determined by the image feature determination unit.

The present invention enables calculation of a toner consumption amount with higher accuracy.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail with reference to the accompanying drawings. Note that the following embodiments are merely examples and are not intended to limit the scope of the present invention.

First Embodiment

An electrophotographic color image forming apparatus will be exemplified below as an image forming apparatus according to the first embodiment of the present invention.

<Apparatus Arrangement>

Figure 1:
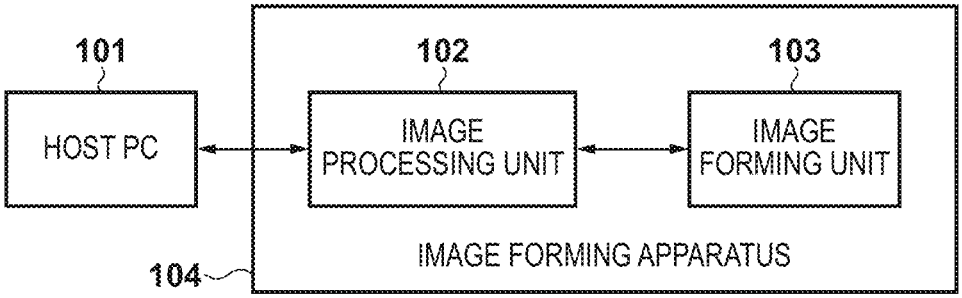
FIG. 1 is a block diagram showing the arrangement of a system including an image forming apparatus according to the first embodiment.

FIG. 1 is a block diagram showing the arrangement of a system including an image forming apparatus according to the first embodiment. An image forming apparatus 104 comprises an image processing unit 102 and an image forming unit 103. Various kinds of communications such as a print instruction from a host PC 101 to the image processing unit 102, a notification of a state from the image processing unit 102 to the host PC 101 are performed between the host PC 101 and the image processing unit 102.

In the print mode, an image signal is transmitted from the host PC 101 to the image processing unit 102. Various kinds of communications such as instructions of various kinds of control from the image processing unit 102 to the image forming unit 103 and a notification of a state from the image forming unit 103 to the image processing unit 102 are performed between the image processing unit 102 and the image forming unit 103. In the print mode, a laser driving signal having undergone image processing (to be described later) is transmitted from the image processing unit 102 to the image forming unit 103.

Figure 2:
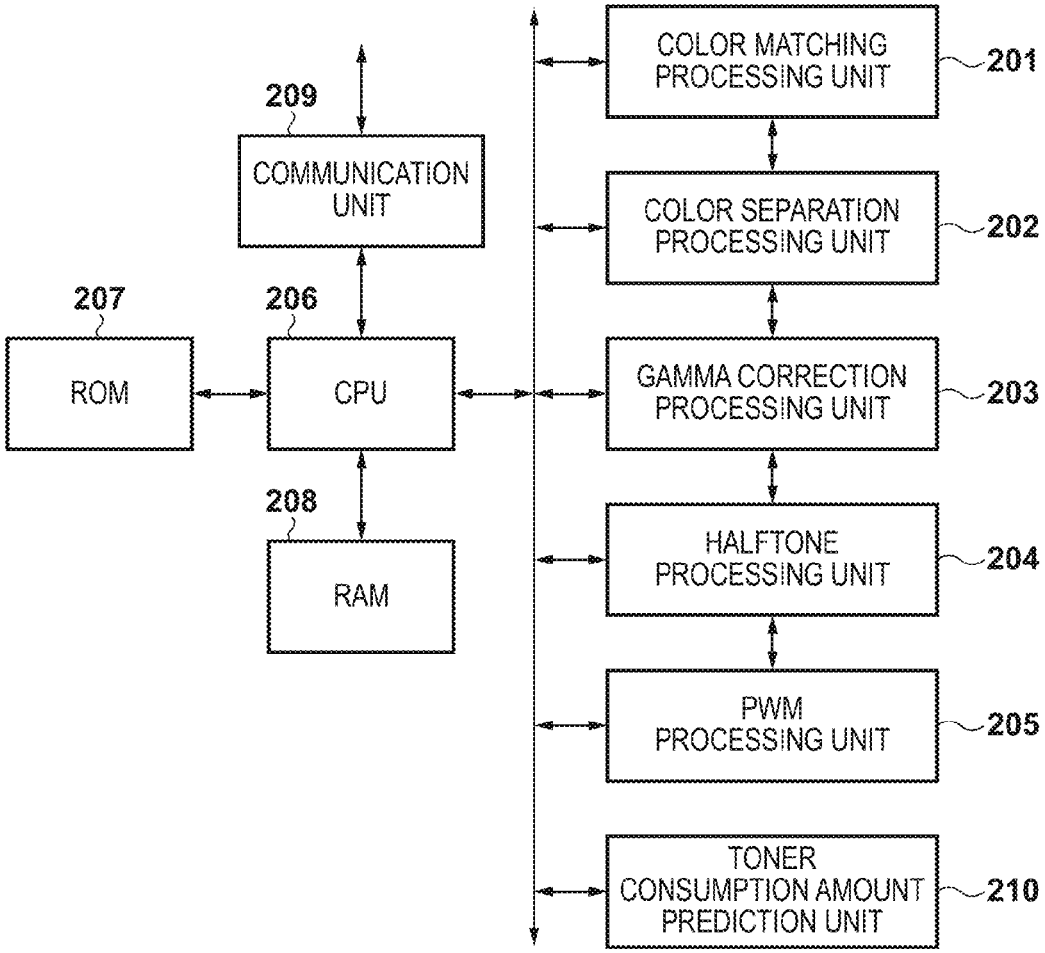
FIG. 2 is a block diagram showing the arrangement of an image processing unit 102.

FIG. 2 is a block diagram showing the arrangement of the image processing unit 102. A CPU 206 comprehensively controls the respective processing components and the entire system in the image processing unit 102 based on programs stored in a ROM 207. A RAM 208 is used as a work area of the CPU 206.

A communication unit 209 performs various kinds of communications with the host PC 101. Printing starts in accordance with a print instruction from the host PC 101 to the communication unit 209. A color matching processing unit 201 converts RGB signals representing the colors of an image transmitted from the host PC 101 into device RGB (DevRGB) signals matching with the color reproduction range of the image forming apparatus 104. Using a color separation table prepared in the ROM 207 in advance, a color separation processing unit 202 converts the DevRGB signals into CMYK signals representing cyan (C), magenta (M), yellow (Y), and black (K) serving as the toner color materials of the image forming apparatus 104.

Using a γ correction table for correcting a tone value-density characteristic stored in the ROM 207, a γ correction processing unit 203 converts the CMYK signals into C'M'Y'K' signals having undergone correction such that the "tone value-density" characteristic has a predetermined relationship with respect to the CMYK signals. After that, a halftone processing unit 204 performs halftone processing for the C'M'Y'K' signals, thereby converting them into C"M"Y"K" signals. The halftone processing unit 204 converts the halftone-processed resolution into a resolution for performing processing in the image forming unit 103 and outputs the result to a PWM processing unit 205.

The PWM processing unit 205 performs PWM (Pulse Width Modulation) to obtain laser driving signals Tc, Tm, Ty, and Tk indicating the exposure time of a laser (not shown) and corresponding to the C"M"Y"K" signals. The PWM processing unit 205 outputs the laser driving signals Tc, Tm, Ty, and Tk to the image forming unit 103. A toner consumption amount prediction unit 210 receives the output signal from the halftone processing unit 204, counts the number of edges and the number of pixels for each region of an image, predicts a toner consumption amount for each region of the image, and accumulates the toner consumption amounts. Note that the color matching processing unit 201, the color separation processing unit 202, the γ correction processing unit 203, the halftone processing unit 204, and the PWM processing unit 205 are formed from logic circuits to allow high-speed operations. In addition, the toner consumption amount prediction unit 210 may predict a toner consumption amount for an image, which is halftone processed and input by the host PC 101. In this case, the host PC 101 transmits resolution information of the halftone processing that the host PC 101 performs to the image forming apparatus 104. The halftone processing is, for example, a dither processing using a dither matrix.

Figure 3:
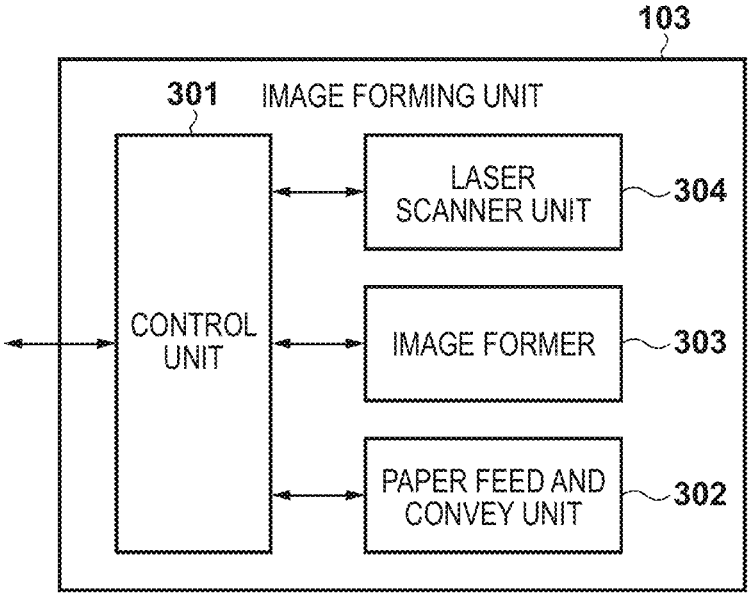
FIG. 3 is a block diagram showing the arrangement of an image forming unit 103.

FIG. 3 is a block diagram showing the arrangement of the image forming unit 103. A control unit 301 is a block for controlling the image forming unit 103 as a whole. The control unit 301 controls a laser scanner unit 304, an image former 303, a paper feed and convey unit 302 in accordance with instructions from the image processing unit 102. When detecting a print instruction from the image processing unit 102, the control unit 301 receives laser driving signals and controls the laser scanner unit 304 to drive the laser. At the same time, the control unit 301 controls the image former 303 to perform a charging process, exposure process, development process, transfer process to a paper sheet, and fixing process sequentially. In addition, the control unit 301 controls the paper feed and convey unit 302 to perform paper feed, paper conveyance, and paper discharge. By the above operations, an image is formed on a paper sheet.

<Prediction of Toner Consumption Amount>

In the first embodiment, one image (for example, a page image) is divided into a plurality of regions, the feature of a region is determined in accordance with the number of edges and the number of pixels for each region, and the toner consumption amount for each region is predicted. In this case, assume that the size of each region has 20 pixels in the main scanning direction and 5 pixels in the sub-scanning direction at a resolution of 600 DPI. Note that when the processing resolution of the toner consumption amount prediction processing is given as 1,200 DPI, the size of each region has 40 pixels in the main scanning direction and 10 pixels in the sub-scanning direction. Note that the size of each region is not limited to this.

Electrophotographic printing often uses halftone processing of 100 to 200 lines. The smaller the number of lines, the longer the cyclic structure. To determine the feature of a region, pixels having a cycle at least twice the cycle of a halftone dot must be referred to. When the cycle of halftone processing is 106 lines and the resolution of halftone processing is 600 DPI, an 8-pixel cycle is obtained. In this case, at least 19 pixels must be referred to in the main scanning direction. In addition, when the resolution of halftone processing is 1,200 DPI, pixels having the number twice or more the case in which the resolution is 600 DPI must be referred to.

Figure 6:
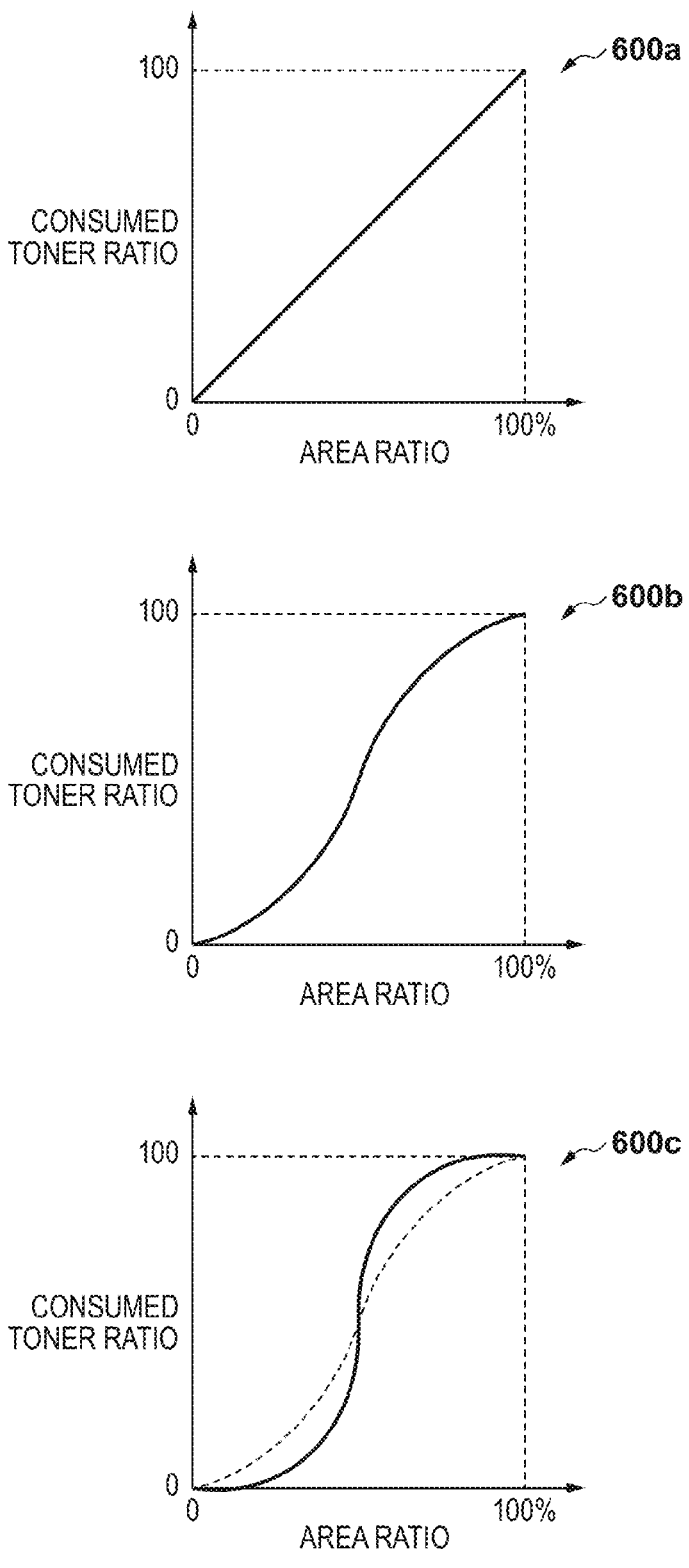
FIG. 6 shows the examples representing the relationships between the area ratios and the consumed toner ratios in the respective image features.

FIG. 6 shows examples representing the relationships between the area ratios and the consumed toner ratios in the respective image features (that is, a character image, a low LPI screen image, and a high LPI screen image). The area ratio is defined as the percentage obtained by dividing the number of recording pixels in each region by the total number of pixels forming the region. Graphs 600*a*, 600*b*, and 600*c* indicate the relationships between the area ratios and the consumed toner ratios in the character image, the low LPI screen image, and the high LPI screen image, respectively. In this case, a screen image having an LPI lower than a predetermined LPI is referred to as a low LPI screen image, while a screen image having an LPI equal to or higher than the predetermined LPI is referred to as a high LPI screen image.

The area ratio of pixels is plotted along the abscissa, while the consumed toner ratio is plotted along the ordinate. The toner amount consumed with an area ratio of 100% is defined as 100. As can be obvious from the graphs 600*b* and 600*c*, the characteristic changes depending on the difference in screen LPI. This is because when the density (tone level) is extremely low, the area of a grown halftone dot is small for a high screen LPI, thereby degrading dot reproducibility in the pixel. When the density is extremely high, the area of a portion (hollow region) other than the halftone dot is small for the high screen LPI, so the hollow portions are connected by toner.

Since the toner consumption amount changes depending on the degree of concentration of recording pixels, an image feature in a given region is determined, and a toner consumption amount table (toner consumption amount calculation table) is switched depending on the image feature, thereby allowing highly accurate toner consumption amount prediction.

Figure 7:
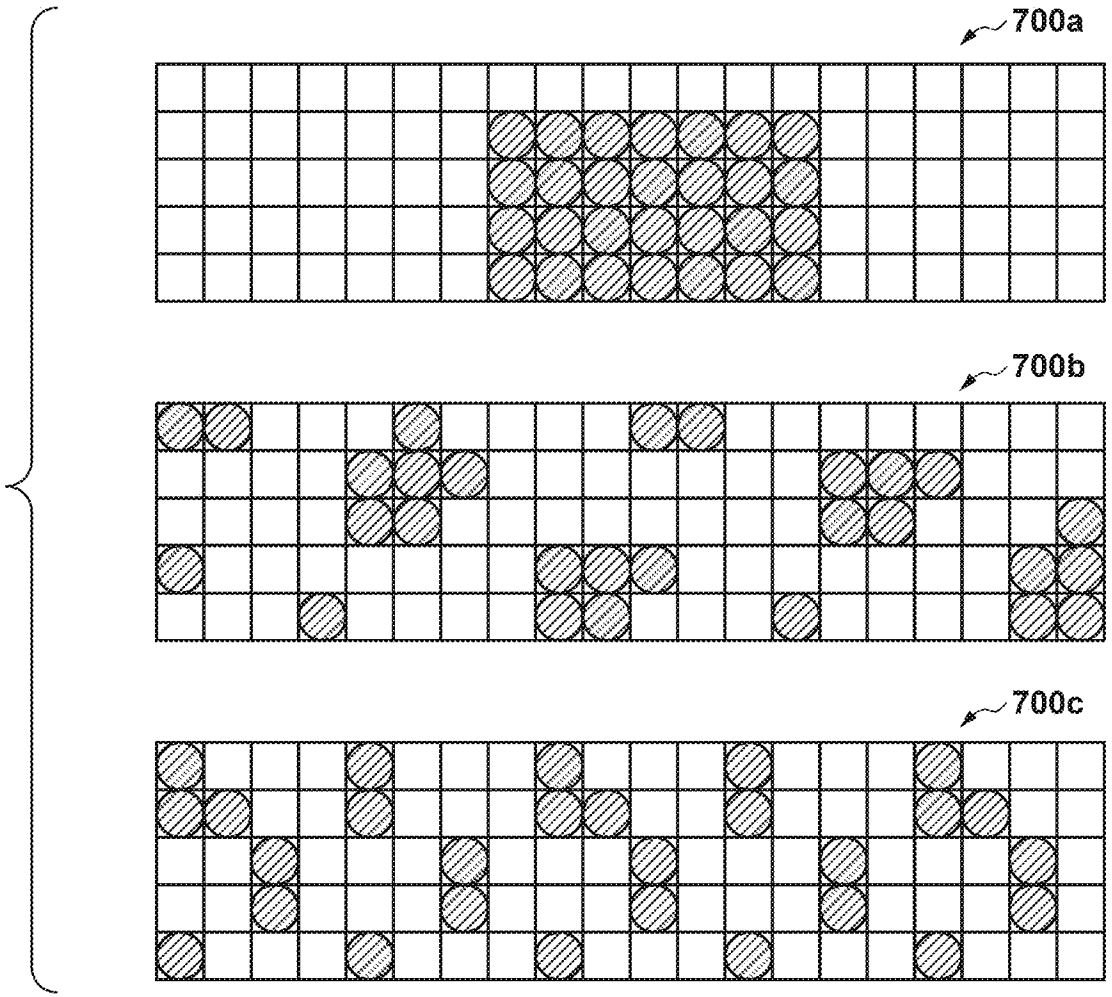
FIG. 7 shows the examples representing the layouts of recording pixels in the respective image features.

FIG. 7 shows examples representing the layouts of recording pixels in the respective image features (that is, the character image, the low LPI screen image, and the high LPI screen image). FIG. 7 shows a case in which recording pixels having the same number (28 pixels) exist in each of the identical rectangular regions (in this case, each region has 20×5 pixels). That is, FIG. 7 shows the case in which the recording pixels having the same number exist at the same area ratio.

The number of edges is defined as the number of sides, for each pixel, which serve as boundaries between a recording pixel and a non-recording pixel. In this case, in a layout 700*a* of the pixels in the character image, the number of recording pixels is "28", and the number of edges is "22". In a layout 700*b* of the pixels in the low LPI screen image (134 lines and 27°), the number of recording pixels is "28" and the number of edges is "66". In a layout 700*c* in the high LPI screen image (212 lines and 45°), the number of recording pixels is "28" and the number of edges is "86".

Figure 8:
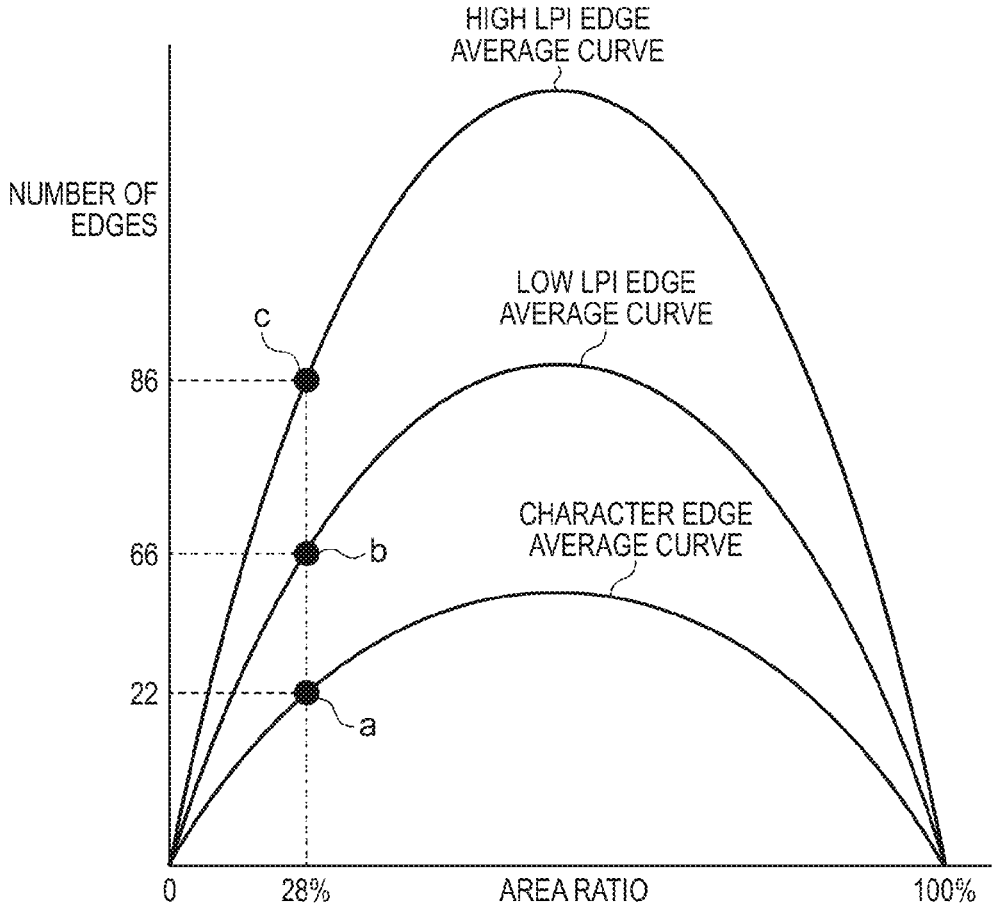
FIG. 8 is a graph showing examples representing the relationships between the area ratios and the numbers of edges in the respective image feature.

FIG. 8 is a graph showing examples representing the relationships between the area ratios and the numbers of edges in the respective image features (that is, the character image, the low LPI screen image, and the high LPI screen image). More specifically, FIG. 8 shows an average value of the numbers of edges with respect to the area ratios of recording pixels in each image feature. The three curves in FIG. 8 correspond to the character image, the low LPI screen image, and the high LPI screen image, respectively, from the lowest curve. As can be obvious from FIG. 8, if the area ratio remains unchanged, the edges increase in the order of the character image, the low LPI screen image, and the high LPI screen image. That is, obviously, it is possible to predict and determine a specific image feature in an image region from the area ratio and the number of edges in the image region.

Figure 9:
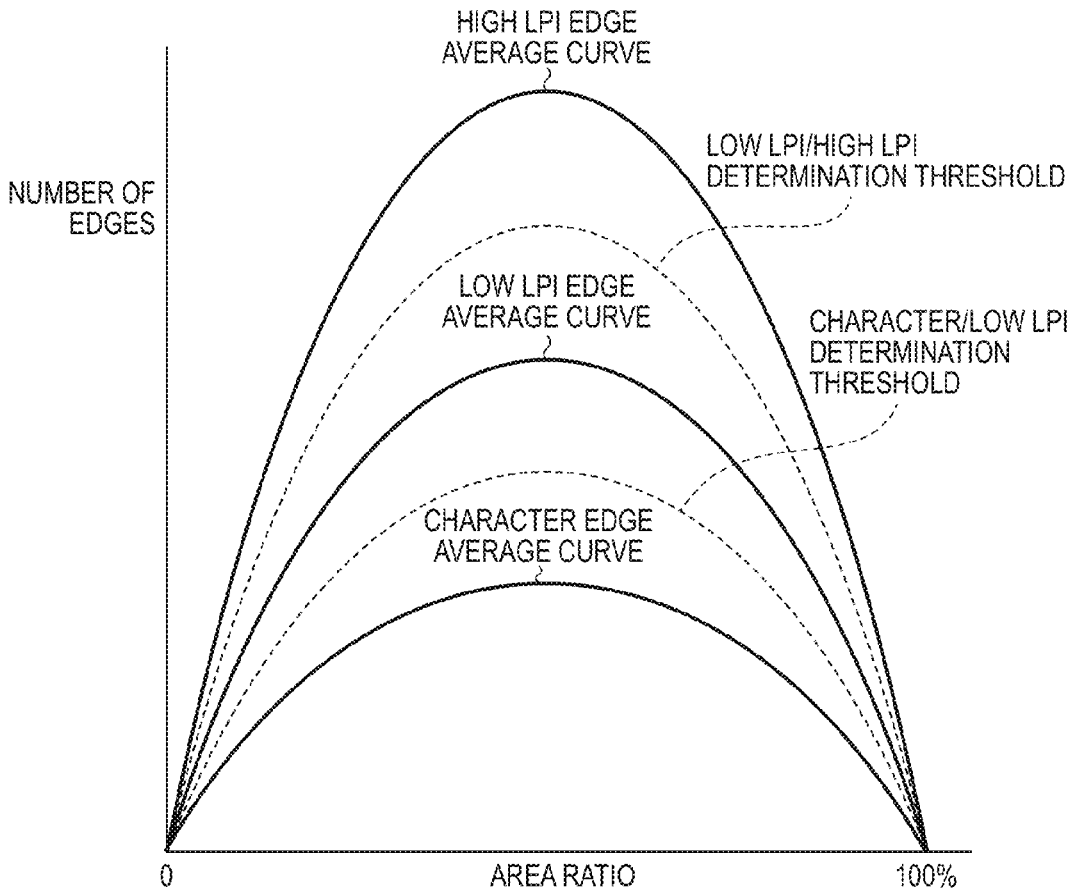
FIG. 9 is a graph showing examples representing the determination thresholds for specifying the respective image features.

FIG. 9 is a graph showing examples of determination thresholds for specifying the respective image features (that is, the character image, the low LPI screen image, and the high LPI screen image). For example, an image feature determination threshold is formed as a determination table representing a character/low LPI determination threshold (first threshold) and a low LPI/high LPI determination threshold (second threshold). The determination table is stored in the RAM 208 or ROM 207 (determination table storage unit).

The character/low LPI determination threshold is a threshold for determining whether a region has a character portion or a low LPI component. If the number of edges in a region is smaller than the character/low LPI determination threshold, the region is determined as the character portion. The low LPI/high LPI determination threshold is a threshold for determining whether a region has a low LPI component or a high LPI component. If the number of edges in a region is larger than the low LPI/high LPI determination threshold, the region is determined as the high LPI region. If the number of edges in a region is equal to or larger than the character/low LPI determination threshold but is equal to or smaller than the low LPI/high LPI determination threshold, the region is determined as the low LPI region. In this manner, the character/low LPI determination threshold and low LPI/high LPI determination threshold which are specified in advance are used to allow determination of the image feature of the region.

For example, the character/low LPI determination threshold is obtained by connecting middle points between a character edge average curve and a low LPI edge average curve. The low LPI/high LPI determination threshold is obtained by connecting middle points between the low LPI edge average curve and a high LPI edge average curve. Here the middle points are connected. However, the method of obtaining the thresholds is not limited to this. A method of connecting middle points of the barycenters of the edges may be used, or the graph cut or the like may be used from the edge distribution. In the above description, the high LPI is given as 212 lines. However, error diffusion may be used as the high LPI. Alternatively, a screen having an extremely low LPI such as 106 lines may be used for the character portion. As will be described below, the character/low LPI determination threshold and the low LPI/high LPI determination threshold are preferably switched in accordance with the resolution of the halftone processing unit 204.

Figure 10:
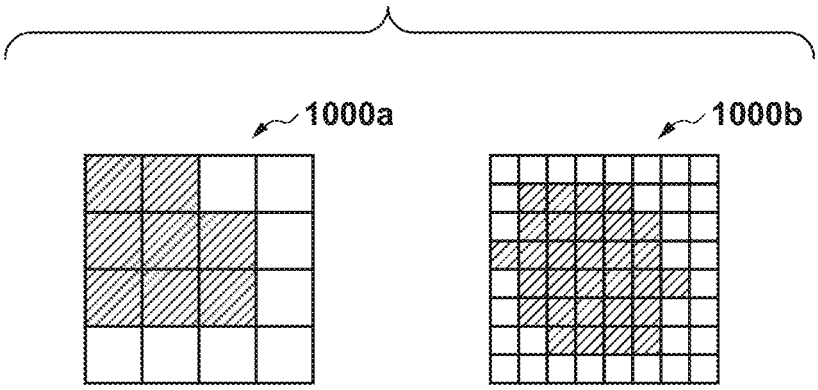
FIG. 10 shows examples showing the pixel shapes in halftone processing of two different resolutions.

FIG. 10 shows examples of pixel shapes in halftone processing of two different resolutions for screen images having the same LPI and the same angle. A pixel shape 1000*a* indicates a pixel shape when the resolution of the halftone processing is 600 DPI. A pixel shape 1000*b* indicates a pixel shape when the resolution of halftone processing is 1,200 DPI. As can be understood from FIG. 10, the shape changes depending on the resolution of halftone processing although the area ratio remains unchanged. That is, the degree of freedom in the pixel layout is higher at the resolution of 1,200 DPI than at the resolution of 600 DPI, and smoother growth is possible. Accordingly, the edge distribution changes depending on the resolution of halftone processing even if screens have the same LPI and the same angle.

Figure 11:
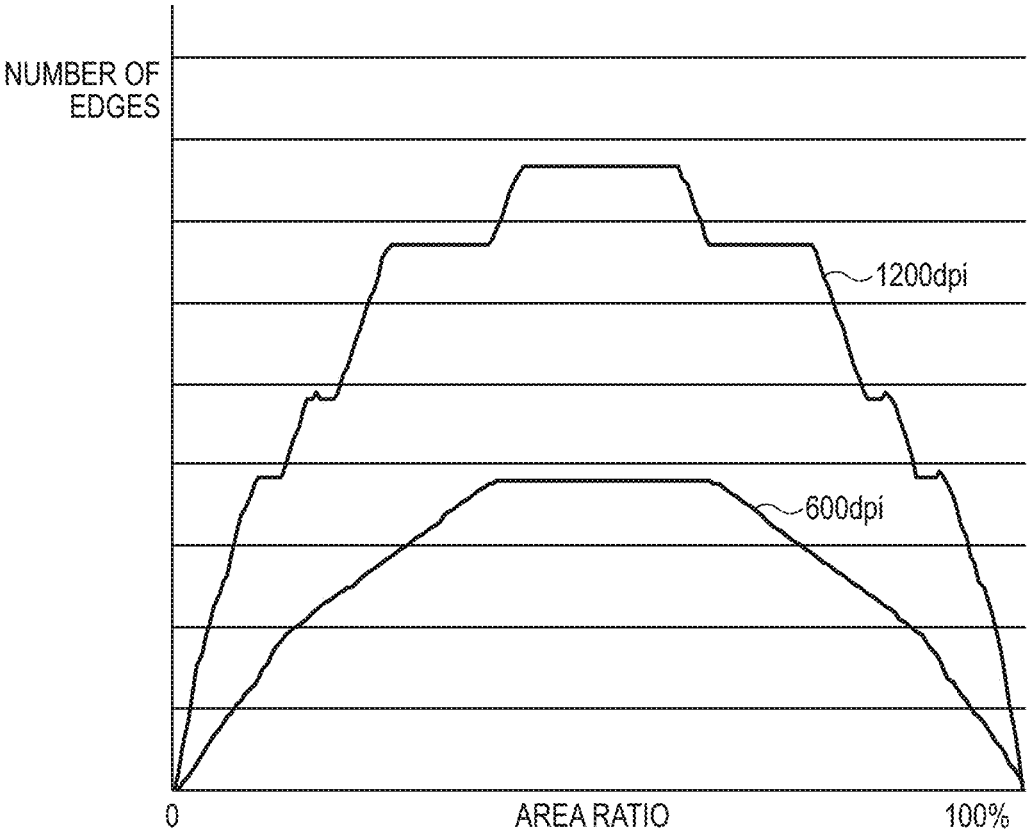
FIG. 11 is a graph showing examples representing the relationships between the area ratios and the numbers of edges in halftone processing of two different resolutions.

FIG. 11 is a graph showing examples representing the relationships between the area ratios and the numbers of edges in halftone processing of two different resolutions for screen images having the same LPI and the same angle. More specifically, FIG. 11 shows the average value of the number of edges with respect to the area ratio in the halftone processing of each resolution. When the resolution of halftone processing is 1,200 DPI, the number of edges is larger than that of the resolution of 600 DPI and has a shape different from that of the resolution of 600 DPI. For this reason, the determination threshold is switched in accordance with the resolution of halftone processing. When resolution switching is not performed, a determination error occurs in the image feature determination processing. A wrong toner consumption amount table is referred to. As a result, a toner consumption amount prediction error occurs.

<Operation of Apparatus>

Figure 4:
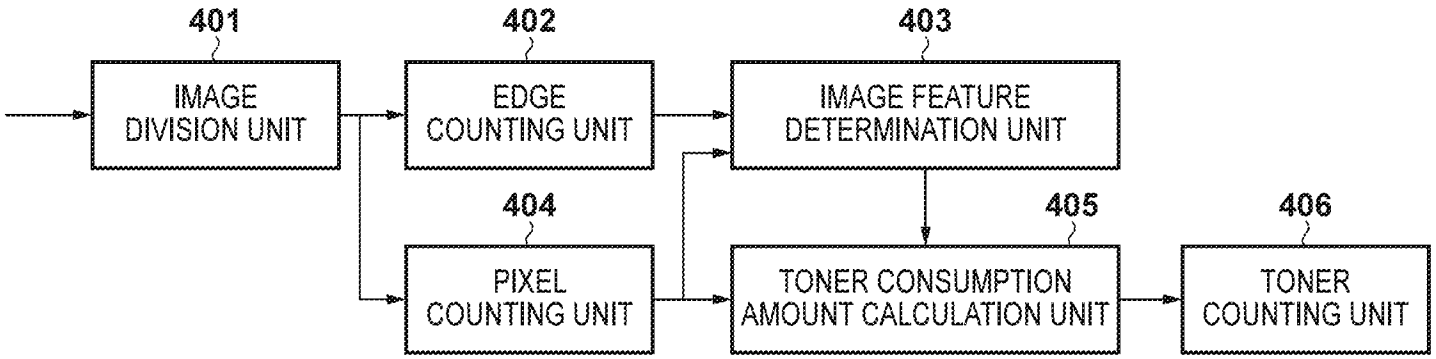
FIG. 4 is a block diagram showing the arrangement of a toner consumption amount prediction unit 210.
Figure 5A:
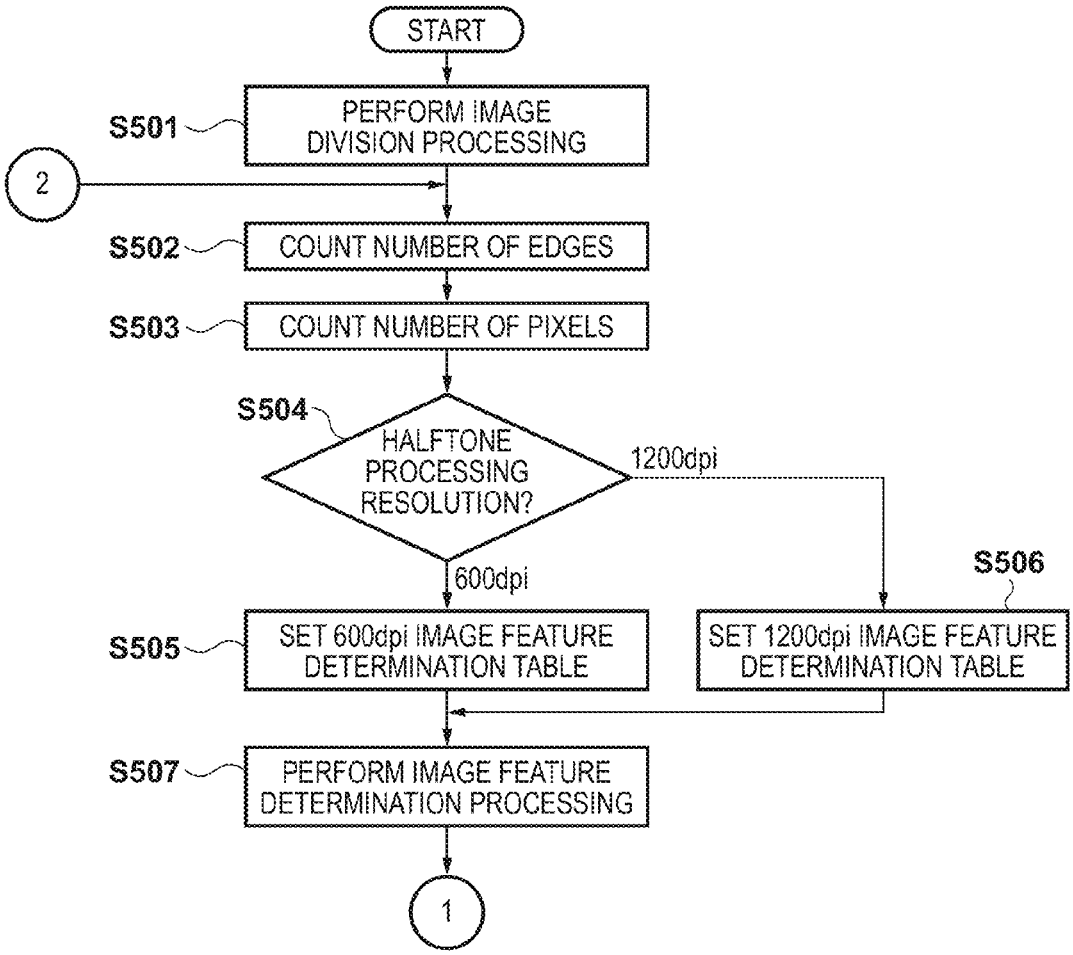
FIGS. 5A and 5B are flowcharts of toner consumption amount prediction processing according to the first embodiment.
Figure 5B:
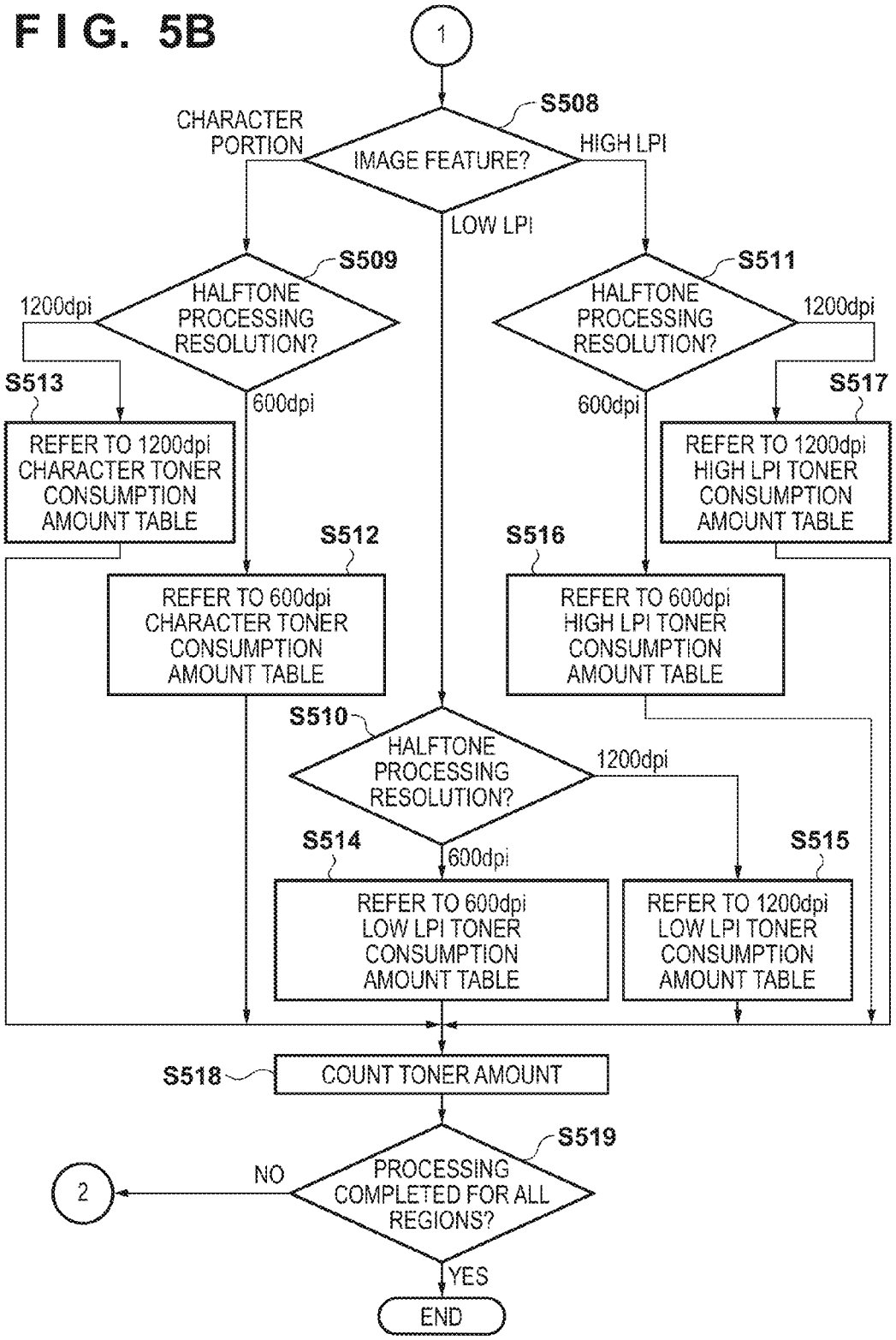

FIG. 4 is a block diagram showing the arrangement of the toner consumption amount prediction unit 210. FIGS. 5A and 5B are a flowchart of toner consumption amount prediction processing according to the first embodiment.

In step S501, an image division unit 401 receives an output from the halftone processing unit 204, divides the input image into regions, and outputs the divided regions to an edge counting unit 402 and a pixel counting unit 404. As described above, assume that the size of each region has 20 pixels in the main scanning direction and 5 pixels in the sub-scanning direction.

In step S502, the edge counting unit 402 counts the number of edges in a region of interest (in the image). In the region of interest, the pixel value of the pixel of interest is compared with the pixel value of the right adjacent pixel and the pixel value of the lower adjacent pixel. If the pixel values are different, the compared pixels are determined as edges and counted. Similarly, edges are counted in another pixel in the region of interest. In step S503, the pixel counting unit 404 counts the number of recording pixels in the region of interest (in the image).

In step S504, an image feature determination unit 403 (resolution acquisition unit) acquires halftone processing resolution information from the halftone processing unit 204. In steps S505 and S506, the image feature determination unit 403 sets an image feature determination table corresponding to the resolution information. That is, when the halftone processing resolution information is 600 DPI, a 600-DPI image feature determination table is set. When the halftone processing resolution information is 1,200 DPI, a 1,200-DPI image feature determination table is set.

Figure 12:
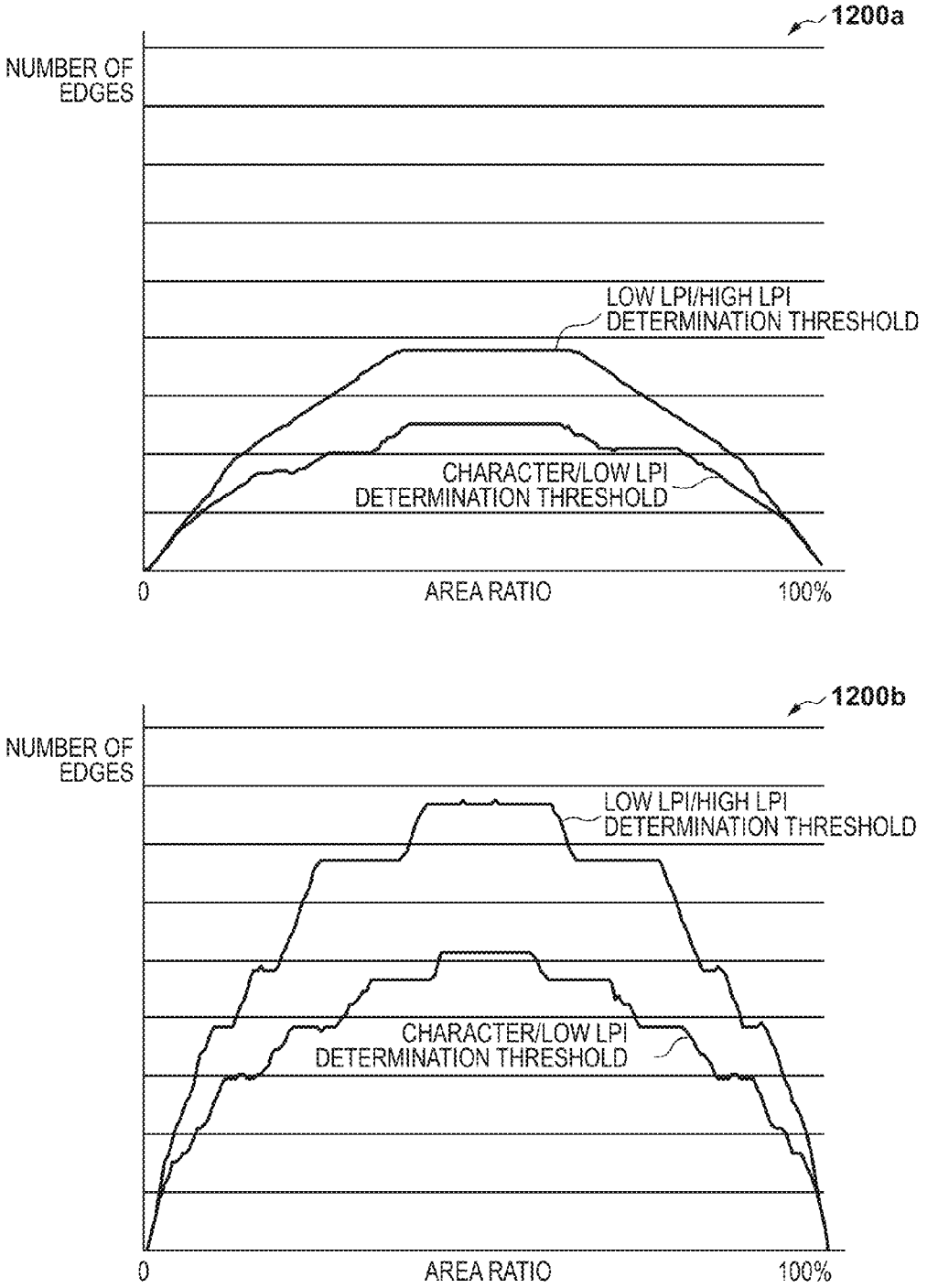
FIG. 12 shows examples representing determination thresholds for specifying the respective image features in the halftone processing of two different resolutions.

FIG. 12 shows examples representing determination thresholds for specifying the respective image features in halftone processing of two different resolutions. A graph 1200*a* indicates a 600-DPI determination threshold, while a graph 1200*b* indicates a 1,200-DPI determination threshold.

In step S507, the image feature determination unit 403 acquires the number of edges in the region of interest from the edge counting unit and the number of pixels in the region of interest from the pixel counting unit. The image feature determination unit 403 determines the image feature of the region of interest with reference to the set image feature determination table. More specifically, when the number of edges in the region of interest is larger than the low LPI/high LPI determination threshold, the region is determined as the high LPI region. To the contrary, when the number of edges in the region of interest is smaller than the character/low LPI determination threshold, the region is determined as the character portion. In addition, when the number of edges in the region of interest is equal to or larger than the character/low LPI determination threshold and equal to or smaller than the low LPI/high LPI determination threshold, the region is determined as the low LPI region.

In steps S508 to S511, a toner consumption amount calculation unit 405 sets a toner consumption amount table based on image feature information output from the image feature determination unit 403 and the halftone processing resolution information and calculates the toner consumption amount of the region of interest.

More specifically, when the image feature of the region of interest indicates the character region and the halftone processing resolution is 600 DPI, the toner consumption amount calculation unit 405 sets the 600-DPI character toner consumption amount table and calculates the toner consumption amount of the region of interest. When the image feature of the region of interest indicates the character region and the halftone processing resolution is 1,200 DPI, the toner consumption amount calculation unit 405 sets the 1,200-DPI character toner consumption amount table and calculates the toner consumption amount of the region of interest.

When the image feature of the region of interest indicates the low LPI screen image and the halftone processing resolution is 600 DPI, the toner consumption amount calculation unit 405 sets the 600-DPI low LPI toner consumption amount table and calculates the toner consumption amount of the region of interest. When the image feature of the region of interest indicates the low LPI screen image and the halftone processing resolution is 1,200 DPI, the toner consumption amount calculation unit 405 sets the 1,200-DPI low LPI toner consumption amount table and calculates the toner consumption amount of the region of interest.

In addition, when the image feature of the region of interest indicates the high LPI screen image and the halftone processing resolution is 600 DPI, the toner consumption amount calculation unit 405 sets the 600-DPI high LPI toner consumption amount table and calculates the toner consumption amount of the region of interest. When the image feature of the region of interest indicates the high LPI screen image and the halftone processing resolution is 1,200 DPI, the toner consumption amount calculation unit 405 sets the 1,200-DPI high LPI toner consumption amount table and calculates the toner consumption amount of the region of interest.

A method of creating a toner consumption table will be described below. The image forming apparatus 104 prints three test patterns using a basic gamma conversion table at the time of creating a toner consumption table. The three test patterns are a character pattern, a low LPI screen pattern, and a high LPI screen pattern. Each pattern includes patches having a plurality of different area ratios. Each toner consumption amount table is created by measuring the test patterns output in this manner. Each toner consumption table thus created is stored in the RAM 208 or ROM 207 (calculation table storage unit and storage unit).

Although the toner consumption amount changes due to an engine variation caused by an external factor, density calibration by the gamma conversion table correction is used. More specifically, the difference between the calibrated gamma conversion table and the basic gamma conversion table at the time of creating the toner consumption table is reflected on the toner consumption amount table. This makes it possible to predict the highly accurate toner consumption amount in consideration of the engine variation.

In step S518, a toner counting unit 406 accumulates toner consumption amounts calculated for the respective regions by the toner consumption amount calculation unit 405 to calculate the toner amount consumed for the entire image (for example, a page image).

In step S519, the toner counting unit 406 determines whether processing is done for all the regions. If an unprocessed region exists, the process returns to step S502. On the other hand, it is determined that processing is done for all the regions, toner consumption amount prediction processing ends.

As has been described above, according to the first embodiment, the image is divided into the plurality of regions, and the image feature of each region is determined based on the number of edges and the number of recording pixels included in the region. The toner consumption amount is predicted with reference to the toner consumption amount table corresponding to the determination result. In particular, different toner consumption amount tables are referred to in accordance with the halftone processing resolutions of the respective regions even if these regions have the same image feature. With this arrangement, it is possible to predict the toner consumption amount with higher accuracy.

Second Embodiment

The second embodiment will describe a case in which image processing such as smoothing for reducing a step in a character or line is performed after processing in a halftone processing unit 204. Note that in the following description, the same arrangement and operation as in the first embodiment will not be repeated.

Figure 15:
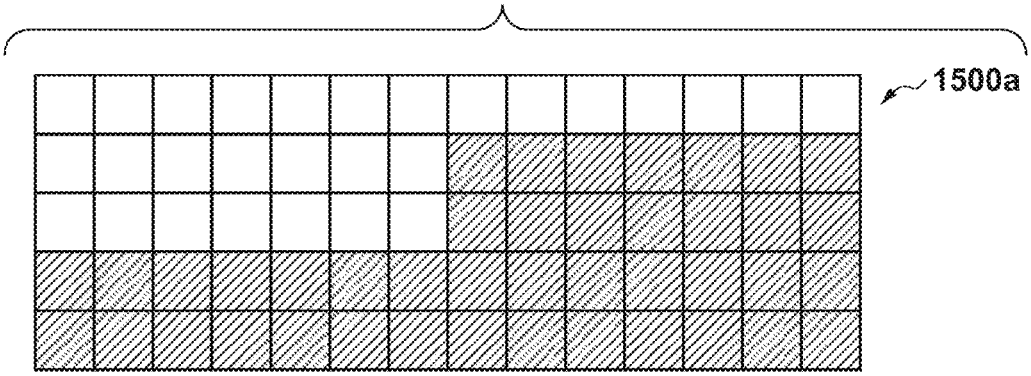
FIG. 15 explains image correction processing for an edge having undergone smoothing correction processing.
Figure 15:
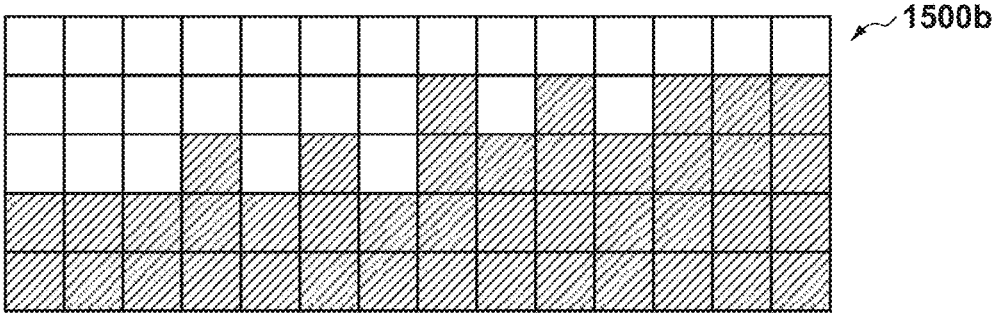
Figure 15:
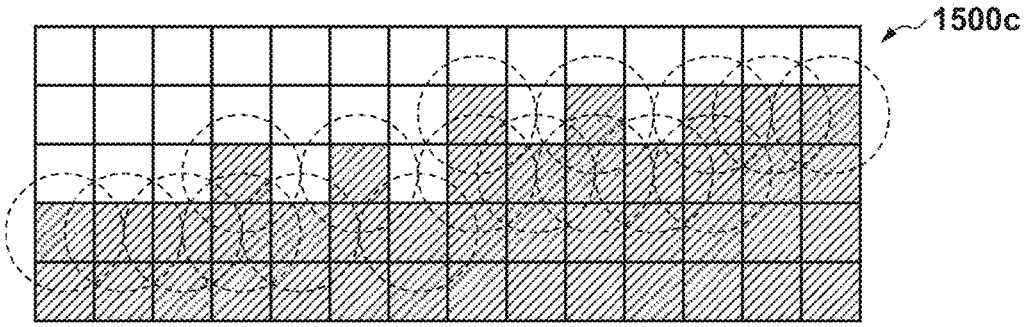

FIG. 15 explains image correction processing for edges having undergone smoothing correction processing. An image 1500*a* exemplifies an image immediately after halftone processing. The image includes edges having a step at the central portion. An image 1500*b* shows an example of the image 1500*a* having undergone image correction processing (smoothing processing) by an image correction unit 211.

The number of pixels remains unchanged before and after the image correction processing, but the number of edges increases after the image correction processing. That is, the image feature determination processing accuracy degrades in the image having undergone smoothing correction processing. As a result, the prediction accuracy of the toner consumption amount by a toner consumption amount prediction unit 210 degrades.

For example, a region like the image 1500*b* should be determined as a character image. This is because each laser spot (indicated by a dotted circle) is larger than a pixel and a fine pixel cannot be reproduced due to the electrophotographic characteristic as in an image 1500*c*. However, since the number of edges is large in the image 1500*b*, an image feature determination unit 403 determines the image not as the character image but as the low LPI screen image at a high possibility. When such an image feature determination error occurs, the error adversely affects the toner consumption amount prediction accuracy. For this reason, it is ideal for the toner consumption prediction unit 210 to detect, as an edge, the envelope of each laser spot (dotted circle) indicated in the image 1500*c*.

Figure 13:
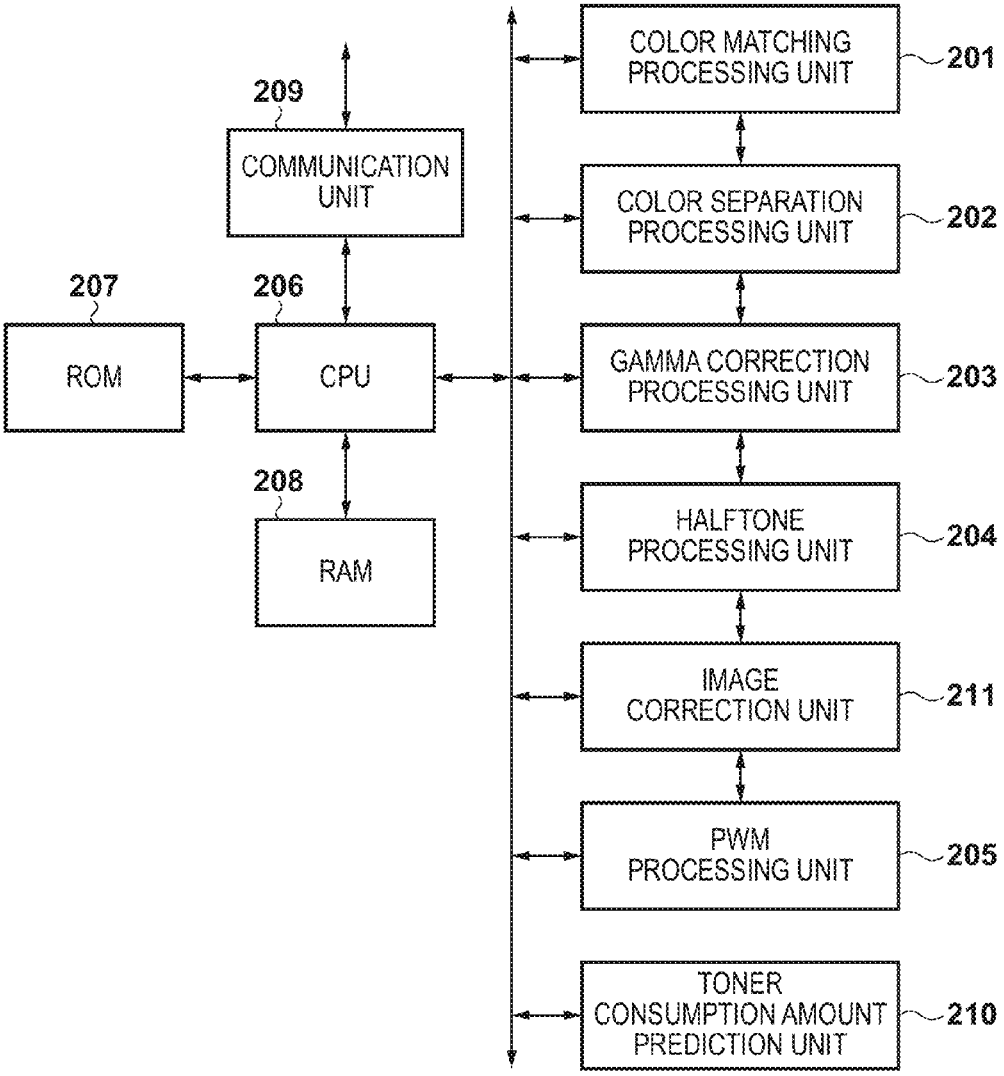
FIG. 13 is a block diagram showing the arrangement of an image processing unit 102 according to the second embodiment.

FIG. 13 is a block diagram showing the arrangement of the image processing unit 102 according to the second embodiment. A CPU 206 comprehensively controls the respective processing components and the entire system in an image processing unit 102 based on programs stored in a ROM 207. The second embodiment will exemplify a case in which the image correction unit 211 performs image correction processing (smoothing processing) after the halftone processing unit 204.

Figure 14:
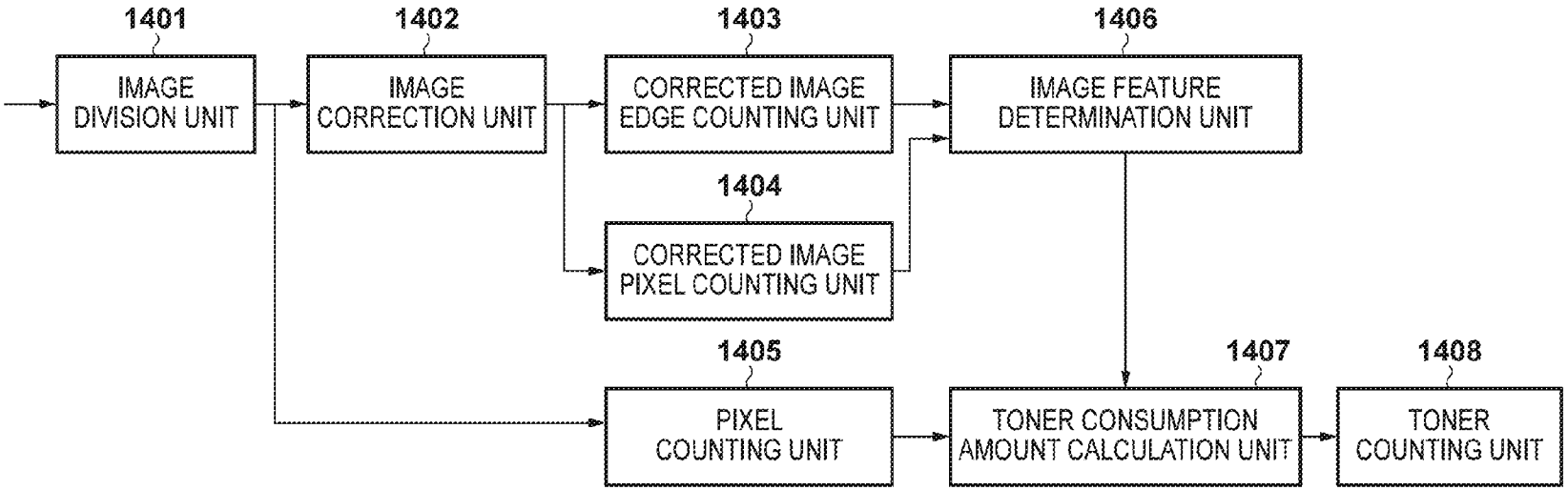
FIG. 14 is a block diagram showing the arrangement of a toner consumption amount prediction unit 210 according to the second embodiment.
Figures 16, 17, 18:
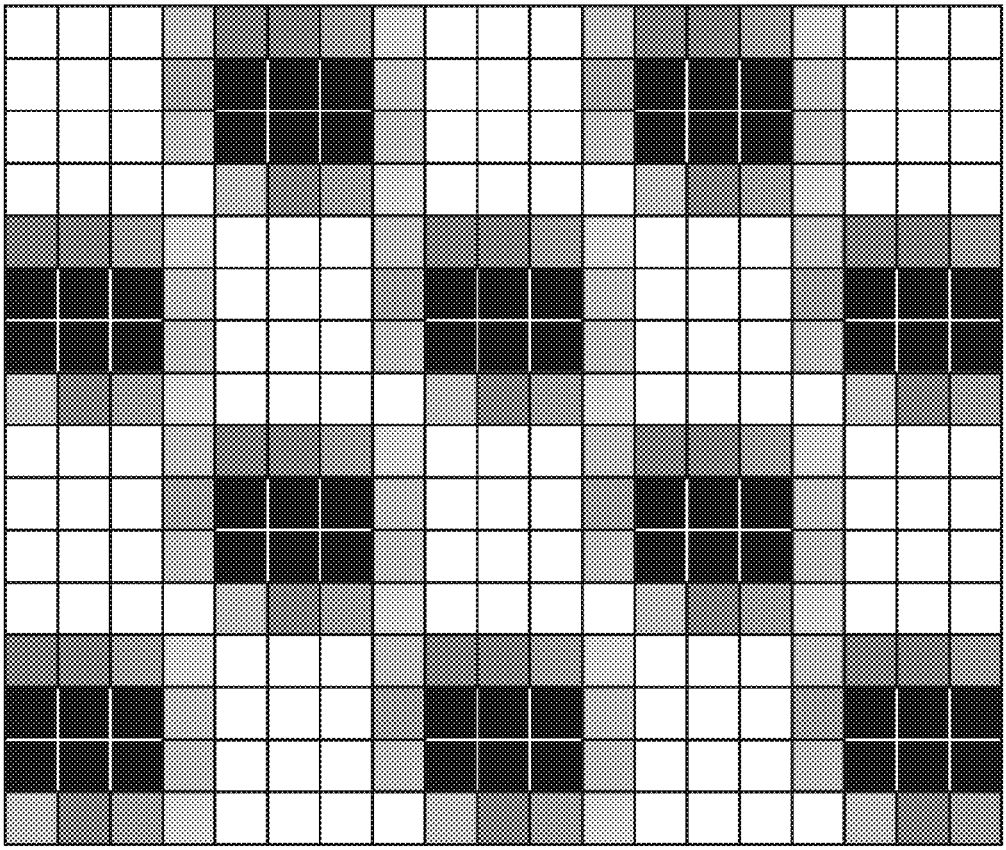
FIG. 16 is a view showing an example of pixel reproducibility information.
FIG. 17 is a view showing an example of an output result image when an output from halftone processing is a multi-level output.
FIG. 18 is a view showing an example of an edge enhancement filter.

FIG. 14 is a block diagram showing the arrangement of the toner consumption amount prediction unit 210 according to the second embodiment. FIG. 16 is a view showing a filter matrix as an example of pixel reproducibility information. An image division unit 1401 receives an output from the halftone processing unit 204, divides the input image into regions, and outputs the divided regions to an image correction unit 1402 and a pixel counting unit 1405. In this case, assume that the size of each region has 20 pixels in the main scanning direction and 5 pixels in the sub-scanning direction as in the first embodiment.

FIG. 15 is a view for explaining image correction processing for edges having undergone smoothing correction processing. The image correction unit 1402 acquires the filter matrix (pixel reproducibility information) shown in FIG. 16 from a RAM 208 or the ROM 207 and performs correction processing (filter processing) using the acquired pixel reproducibility information. An image obtaining by performing filter processing for the image 1500*b* based on the pixel reproducibility information is an image 1500*d*. In the image 1500*d*, a signal value after filter processing is indicated in the square indicating each pixel. A hatched image of the image 1500*d* indicates a binarization result obtained using the signal value "128" as a threshold. In the image 1500*b*, the number of edges in the region is "24". But in the image 1500*d*, the number of edges is reduced to "16".

A corrected pixel edge counting unit 1403 counts the number of edges in an image having undergone image correction processing. A corrected pixel counting unit 1404 counts the number of recording pixels having undergone image correction processing. The pixel counting unit 1405 counts the number of recording pixels of an output image from the image division unit 1401.

An image feature determination unit 1406 switches between image feature determination tables using the halftone processing resolution information acquired from the halftone processing unit 204. The image feature determination unit 1406 determines an image feature from the numbers of edges and recording pixels having undergone image correction processing and the image feature determination table.

A toner consumption amount calculation unit 1407 calculates a toner consumption amount from the image feature determined from the image having undergone image correction processing and the number of recording pixels of the image output from the image division unit 1401. A toner counting unit 1408 accumulates the toner consumption amounts calculated for the respective regions by the toner consumption amount calculation unit 1407 and calculates a toner amount consumed in the entire image.

As has been described above, according to the second embodiment, the image is corrected using the predetermined pixel reproducibility information, and the image feature is appropriately determined even if the image has undergone the image correction processing (smoothing processing).

Third Embodiment

The third embodiment will describe a case in which an output from a halftone processing unit 204 is a multilevel output. In this case, an edge portion in an image is blurred, and image feature determination may not be correctly performed.

FIG. 17 is a view showing an example of an output result image when the output from the halftone processing unit 204 is a multilevel output. As shown in FIG. 17, obviously, edge portions are blurred. The edge determination accuracy is directly related to the image feature determination accuracy. Poor accuracy of image feature determination greatly degrades the prediction accuracy of the toner consumption amount.

To solve this problem, according to the third embodiment, an image correction unit 1402 corrects an image to improve the determination accuracy of edges. More specifically, the image correction unit 1402 applies edge enhancement filter processing for an input multilevel image and binarizes the edge-enhanced image using a predetermined threshold. FIG. 18 is a view showing an example of a filter matrix of the edge enhancement filter. Image feature determination processing is performed for the binarized image thus obtained. This makes it possible to appropriately determine the image feature.

As has been described above, according to the third embodiment, it is possible to predict the toner consumption amount with high accuracy by applying edge enhancement filter processing even if the output from the halftone processing is a multilevel output. In addition, the image correction unit 1402 also performs binarization processing. Processing in a corrected pixel edge counting unit 1403 can be performed commonly if the output from the halftone processing is a multilevel output or binary output. The common processing can reduce the circuit scale of hardware.

Fourth Embodiment

The fourth embodiment can implement highly accurate toner consumption amount prediction even if a region contains different image feature components. More specifically, a plurality of toner consumption amount tables are weighted to perform toner consumption amount prediction.

According to the first embodiment, a toner consumption amount calculation unit 405 switches the toner consumption table to be referred to, in accordance with the determination result of an image feature determination unit 403. This is because an image feature component in a region is constant. However, an image containing both a character portion and a halftone portion or an image containing a high-frequency component exists.

For example, when the first half of a region is a low LPI component and the second half of the region is a character portion, the number of edges has a value between those of the low LPI component and the character portion. In the first embodiment, an image is determined as a low LPI screen image or a character image in accordance with the threshold, and the toner consumption table of the determined image feature is referred to. However, in general, a method of calculating a toner consumption amount by weighting a corresponding toner consumption table in accordance with a ratio between the occupation ratio of the low LPI screen image and the occupation ratio of the character image has higher accuracy.

Figure 19:
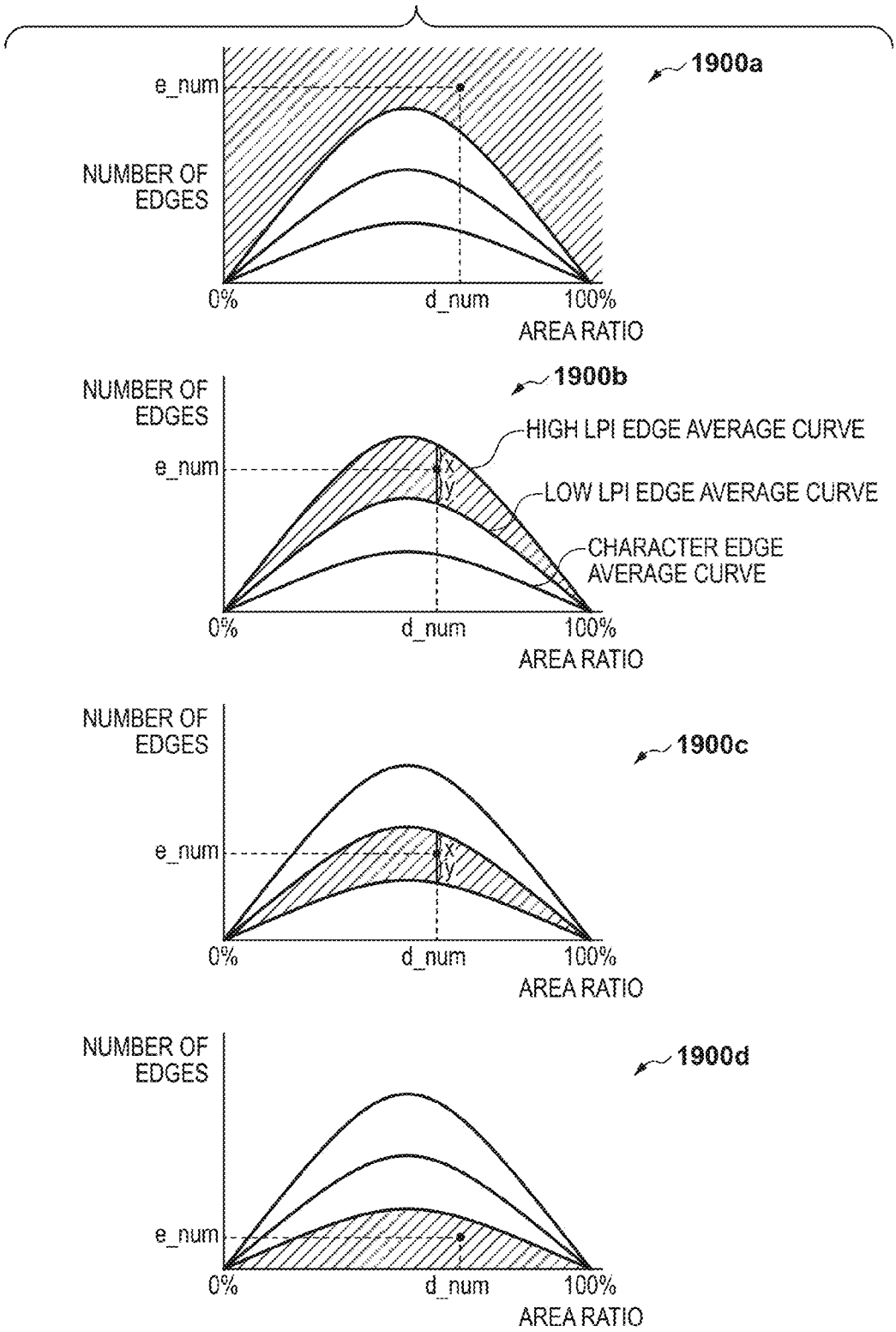
FIG. 19 shows examples of edge average curves in four different states.

FIG. 19 shows examples of edge average curves in four different states. A graph 1900*a* indicates a state in which the number of edges in a region is larger than a high LPI edge average curve. A graph 1900*b* indicates a state in which the number of edges in a region is smaller than the high LPI edge average curve and larger than a low LPI edge average curve. A graph 1900*c* indicates a state in which the number of edges in a region is smaller than the low LPI edge average curve and larger than the character portion edge average curve. A graph 1900*d* indicates a state in which the number of edges in a region is smaller than the character portion edge average curve. In this case, d_num indicates the area ratio of the recording pixels, and e_num is the number of edges.

In the graph 1900*b*, a distance between a coordinate point (d_num, e_num) and the high LPI edge average curve is defined as x, and a distance between a coordinate point (d_num, e_num) and the low LPI edge average curve is defined as y. In the graph 1900*c*, a distance between a coordinate point (d_num, e_num) and the low LPI edge average curve is defined as x, and a distance between a coordinate point (d_num, e_num) and the character portion edge average curve is defined as y.

Figure 20:
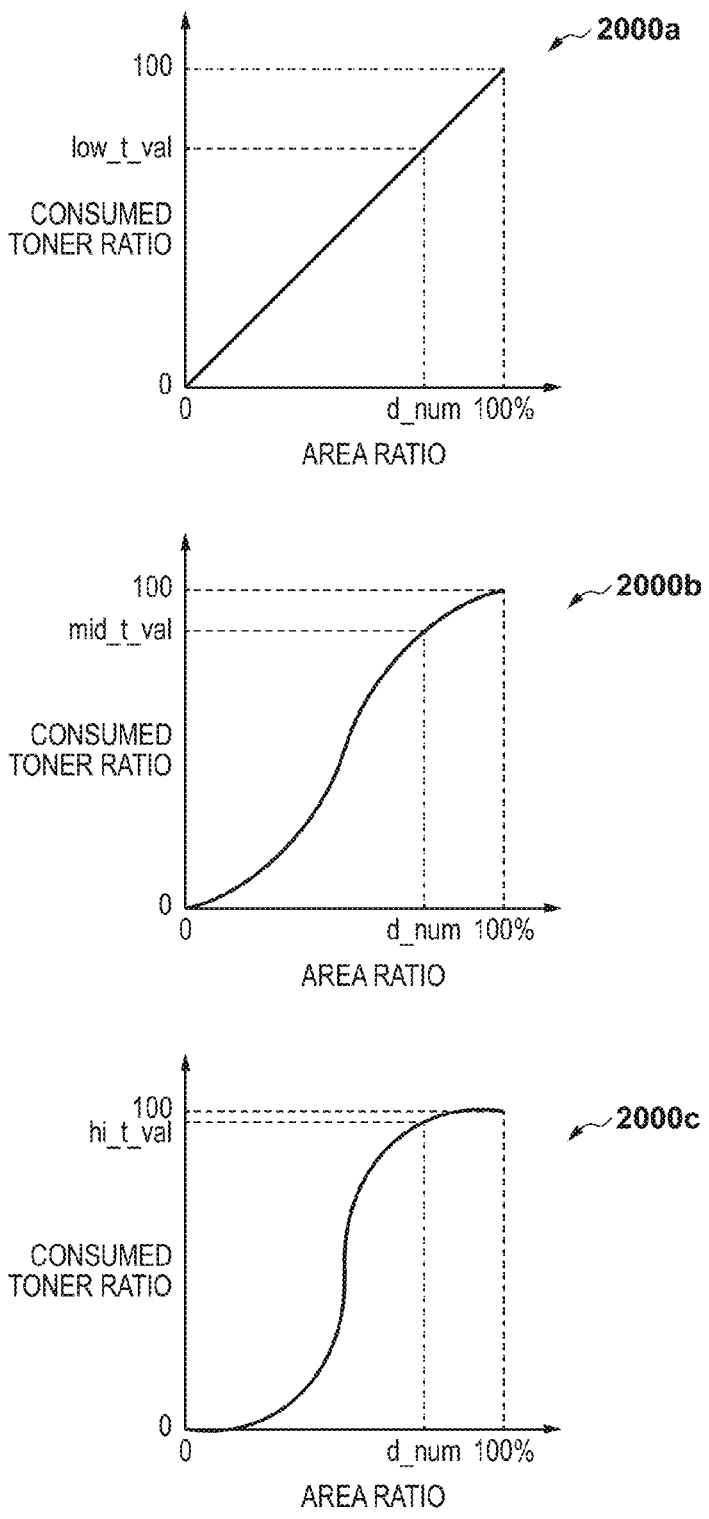
FIG. 20 shows examples representing the relationships between the area ratios and the consumed toner ratios in the respective image features.

FIG. 20 shows examples representing the relationships between the area ratios and the consumed toner ratios in the respective image features. More specifically, a graph 2000*a* indicates a toner consumption amount low_t_val with respect to d_num when the image feature is the character image. A graph 2000*b* indicates a toner consumption amount mid_t_val with respect to d_num when the image feature is the low LPI screen image. A graph 2000*c* indicates a toner consumption amount hi_t_val with respect to d_num when the image feature is the high LPI screen image. In the following description, toner calculation methods in the four states shown in FIG. 19 will be described below.

When the number of edges in a region is larger than the high LPI edge average curve, a predicted toner consumption amount TonerVal in the region of interest can be calculated by:

$$\text{TonerVal}=\text{hi_}t\text{_val}$$

When the number of edges in a region is smaller than the high LPI edge average curve and larger than the low LPI edge average curve, a predicted toner consumption amount TonerVal in the region of interest is calculated by:

$$\text{TonerVal}=\text{hi_}t\text{_val}\times y/(x+y)+\text{mid_}t\text{_val}\times x/(x+y)$$

When the number of edges in a region is smaller than the low LPI edge average curve and larger than the character portion edge average curve, a predicted toner consumption amount Toner Val of the region of interest is calculated by:

$$\text{TonerVal}=\text{mid_}t\text{_val}\times y/(x+y)+\text{low_}t\text{_val}\times x/(x+y)$$

When the number of edges in a region is smaller than the character portion edge average curve, a predicted toner consumption amount TonerVal in the region of interest is calculated by:

$$\text{TonerVal}=\text{low_}t\text{_val}$$

More specifically, according to the fourth embodiment, the toner consumption amount is calculated by linear interpolation in accordance with a distance of the number of edges (e_num) from each edge average curve. Note that the practical calculation expression is not limited to this. An arbitrary function or nonlinear interpolation method may be used.

As has been described above, according to the fourth embodiment, when a plurality of image features are contained in a region, the toner consumption amount is calculated using linear interpolation in accordance with a distance of the number of edges from the corresponding edge average curve. With this arrangement, the toner consumption amount can be predicted with high accuracy even when a plurality of image features are contained in a region.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-018830, filed Feb. 3, 2014 which is hereby incorporated by reference herein in its entirety.

What is claimed is:

1. A method of controlling an image processing apparatus, comprising:

storing a plurality of determination tables corresponding to a plurality of halftone processing resolutions, which are different from each other, respectively;

performing halftone processing for an image and generating a halftone processed image;

obtaining a resolution of the halftone processing;

selecting, by using at least the obtained resolution of the halftone processing, a determination table corresponding to the resolution of the halftone processing from among the stored plurality of determination tables; and predicting, by using the selected determination table, a printing material consumption amount for the halftone processed image.

2. A non-transitory computer-readable recording medium storing a program that causes a computer to function as:

a storing unit configured to store a plurality of determination tables corresponding to a plurality of halftone processing resolutions, which are different from each other, respectively;

a halftone processing unit configured to perform halftone processing for an image and to generate a halftone processed image;

an obtaining unit configured to obtain a resolution of the halftone processing in the halftone processing unit;

a selection unit configured to select, by using at least the resolution of the halftone processing obtained by the obtaining unit, a determination table corresponding to the resolution of the halftone processing from among the plurality of determination tables stored in the storing unit; and a prediction unit configured to predict, by using the determination table selected by the selection unit, a printing material consumption amount for the halftone processed image.

3. An image processing apparatus comprising:

a storing unit configured to store a plurality of determination tables corresponding to a plurality of halftone processing resolutions, which are different from each other, respectively;

a halftone processing unit configured to perform halftone processing for an image and to generate a halftone processed image;

an obtaining unit configured to obtain a resolution of the halftone processing in the halftone processing unit;

a selection unit configured to select, by using at least the resolution of the halftone processing obtained by the obtaining unit, a determination table corresponding to the resolution of the halftone processing from among the plurality of determination tables stored in the storing unit; and a prediction unit configured to predict, by using the determination table selected by the selection unit, a printing material consumption amount for the halftone processed image.

4. The apparatus according to claim 3, further comprising:

an edge counting unit configured to count a number of edges forming boundaries between recording pixels and non-recording pixels of the halftone processed image generated by the halftone processing unit; and a pixel counting unit configured to count a number of recording pixels of the halftone processed image, wherein the selection unit selects the determination table by using the resolution of the halftone processing obtained by the obtaining unit, the number of edges and the number of recording pixels.

5. The apparatus according to claim 4, further comprising a correction unit configured to perform filter processing and binarization processing on the image which has not been halftone processed by the halftone processing unit, in a case where the image is an image having undergone smoothing correction processing, wherein the edge counting unit counts the number of edges for the image corrected by the correction unit, and the pixel counting unit counts the number of recording pixels for the image corrected by the correction unit.

6. The apparatus according to claim 4, further comprising a filter unit configured to perform edge enhancement filter processing for the image which has not been halftone processed by the halftone processing unit, wherein the edge counting unit counts the number of edges of the image edge-enhanced by the filter unit, and the pixel counting unit counts the number of recording pixels for the image edge-enhanced by the filter unit.

7. The apparatus according to claim 4, further comprising:

a division unit configured to divide the halftone processed image into a plurality of regions, wherein the edge counting unit counts the number of edges for each divided region, the pixel counting unit counts the number of recording pixels for each divided region, and the prediction unit selects a printing material consumption amount table for each divided region by using the resolution of the halftone processing obtained by the obtaining unit, the number of edges and the number of recording pixels, calculates a toner consumption amount for each divided region by using the selected printing material consumption amount table, and calculates the printing material consumption amount for the halftone processed image by accumulating printing material consumption amounts calculated for the respective regions.

8. An image processing apparatus comprising:

a storing unit configured to store a plurality of determination tables respectively corresponding to a plurality of resolutions of a halftone processing, wherein a plurality of determination tables are stored for each resolution of the halftone processing;

an obtaining unit configured to obtain a resolution of the halftone processing which is used for generating a halftone processed image;

a selection unit configured to select, by using at least the resolution of the halftone processing obtained by the obtaining unit, a determination table corresponding to the resolution of the halftone processing from among the plurality of determination tables stored in the storing unit; and a prediction unit configured to predict, by using the determination table selected by the selection unit, a printing material consumption amount for the halftone processed image.

9. The apparatus according to claim 8, further comprising:

an edge counting unit configured to count a number of edges forming boundaries between recording pixels and non-recording pixels of the halftone processed image; and a pixel counting unit configured to count a number of recording pixels of the halftone processed image, wherein the selection unit selects the determination table by using at least the resolution of the halftone processing obtained by the obtaining unit, the number of edges and the number of recording pixels.

10. The apparatus according to claim 8, wherein the determination tables are tables for determining a screen LPI of the halftone processed image, and the selection unit selects the determination table based on at least the number of edges and the number of recording pixels.

11. A method of controlling an image processing apparatus, comprising:

storing a plurality of determination tables respectively corresponding to a plurality of resolutions of a halftone processing, wherein a plurality of determination tables are stored for each resolution of the halftone processing;

obtaining a resolution of the halftone processing which is used for generating a halftone processed image;

selecting, by using at least the resolution of the halftone processing obtained in the obtaining step, a determination table corresponding to the resolution of the halftone processing from among the plurality of determination tables stored in the storing step; and predicting, by using the determination table selected in the selecting step, a printing material consumption amount for the halftone processed image.

* * * * *